United States Patent [19]

Beyl

[11] 4,157,193

[45] Jun. 5, 1979

[54] SKI BINDING DEVICE

[76] Inventor: Jean J. A. Beyl, 10, Boulevard Victor Hugo, Nevers, Nievre, France

[21] Appl. No.: 846,126

[22] Filed: Oct. 27, 1977

[30] Foreign Application Priority Data

Nov. 2, 1976 [FR] France ..... 76 32948

[51] Int. Cl.[2] ..... A63C 9/08

[52] U.S. Cl. ..... 280/633

[58] Field of Search ..... 280/626, 627, 628, 631, 280/632, 633, 636

[56] References Cited

U.S. PATENT DOCUMENTS

| | | | |
|---|---|---|---|
| 3,531,135 | 9/1970 | Salomon | 280/633 |
| 3,830,510 | 8/1974 | Stanffer | 280/633 |

FOREIGN PATENT DOCUMENTS

| | | | |
|---|---|---|---|
| 276180 | 11/1969 | Austria | 280/633 |
| 556674 | 10/1971 | Switzerland | 280/633 |

*Primary Examiner*—Robert R. Song

*Attorney, Agent, or Firm*—Bierman & Bierman

[57] ABSTRACT

A hand-operated support for a hooking member which is adapted to engage with a toothed rack rigidly fixed on the ski is maintained in the engaged position by means of locking bosses carried by the boot-binding member and adapted to produce action only when the binding member has been displaced in the longitudinal direction under the pressure exerted by the ski boot when this latter is placed in position, thus preventing any accidental displacement of the hooking member while the ski is in use.

10 Claims, 13 Drawing Figures

F5
XI
XIII
X

SKI BINDING DEVICE

This invention is directed to a ski binding device of the type comprising a heel-holding or toe-holding member, said member being capable of longitudinal displacement along a section member which is rigidly fixed to the ski.

In many different types of ski bindings which are already known, a system is provided for position-adjustment of the heel-holding member and the toe abutment between which the ski-boot is intended to be inserted. In more exact terms, the invention relates to a ski binding system which is comparable with the device described in U.S. Pat. No. 3,897,076. The ski binding described in this patent comprises an adjustment member which is adapted to cooperate with complementary means associated with the aforesaid section member such as a rack, for example. However, said adjustment member can be disengaged from this latter in order to permit rapid displacement of the ski binding casing and thus to perform a first coarse position-adjustment. In this ski binding, the adjustment member is carried by a movable element which is capable of displacement within an enclosed space or housing of the heel-holding member between a first position of engagement of the adjustment member with the rack mounted on the fixed section member and a second position in which the adjustment member is disengaged with respect to the rack of said fixed section member, means preferably consisting of a worm being also provided for locking the movable element in each of the above-mentioned positions with respect to the fixed section member.

Although this type of device does offer appreciable advantages, a number of difficulties or drawbacks have nevertheless arisen under service conditions. Thus it proves necessary in practice to provide a tool for the purpose of actuating the worm which constitutes the movable element. It has also been observed in some cases, for example when the ski is subjected to a fairly violent impact or jerk, that the movable element and its adjustment member are liable to escape from their engaged position on the rack of the fixed section member, which clearly represents a potential danger. This system not only affects the safety of the skier but is also relatively cumbersome.

The aim of the invention is to overcome these drawbacks by providing a ski binding device equipped with a system for length adjustment of the position of the heel-holding member or of the toe abutment. This system has the effect of automatically locking the movable element which supports the adjustment member against any upward displacement with respect to the fixed section member once the ski-boot has been inserted in the binding and engagement of the adjustment member with the section member has taken place.

In accordance with the invention, the ski binding device thus comprises means for carrying out self-locking of the adjustment member in its engaged position on the fixed section member.

In accordance with a first embodiment, the self-locking means aforesaid comprise at least one boss and preferably two bosses located at the top of the housing of the heel-holding member above the adjustment member, said adjustment member being carried by an operating lever which constitutes the movable element. When the lever has been actuated and the adjustment member has engaged in the fixed section member, the longitudinal displacement of the heel-holding member produced by the ski-boot brings the bosses into position above the adjustment member which is consequently locked together with the operating lever in the engaged position.

In accordance with another embodiment, the binding device according to the invention further comprises means for carrying out automatic engagement of the adjustment member from its disengaged position with respect to the fixed section member. By way of example, said means can comprise the aforementioned adjustment member which in this case is slidably mounted on the operating lever. The slider is urged resiliently within the housing of the heel-holding member against a curved wall of said housing when said adjustment member is disengaged with respect to the fixed section member, a tooth or hook of said adjustment member being applied in contact with said wall.

The wall aforesaid is concave and its curvature is such that the adjustment member which is displaced by the spring and its support lever are capable of falling back automatically into the position of engagement of the tooth as soon as the operating lever is released.

Once the operating lever and the adjustment member have been brought to the desired position, it is therefore only necessary to stop pulling the lever in the upward direction in order to ensure automatic engagement of the system for length adjustment of the position of the heel-holding member.

Further distinctive features and advantages of the invention will become apparent from the detailed description which follows below, reference being made to the accompanying drawings which are given by way of example and not in any limiting sense and which illustrate two embodiments of the invention.

Referring to FIGS. 1 to 9, there is shown a first form of construction of the ski binding device contemplated by the invention.

Figure 1:
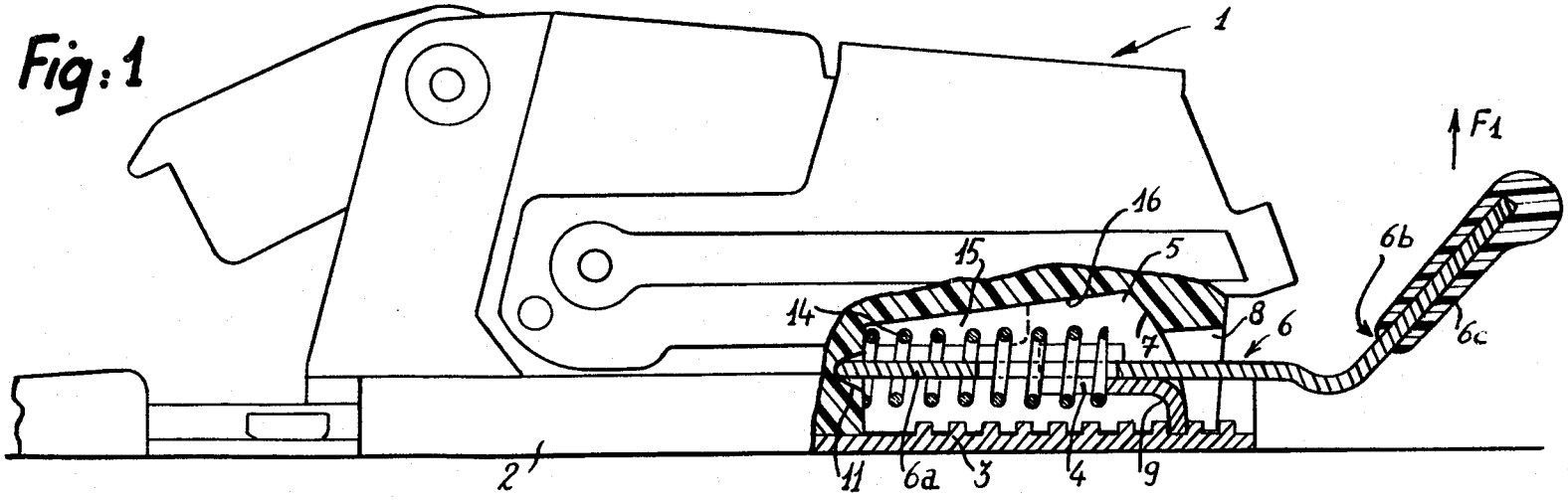
FIG. 1 is a fragmentary view in elevation which illustrates a first embodiment of the ski binding device in accordance with the invention in the case of a heel-holding member and in which the ski boot has not been engaged in the ski binding.

Said device first comprises a heel-holding member 1 as shown generally in FIG. 1. This member is known per se and will therefore not be described in detail. In order to avoid undue complication of the drawings, the corresponding ski boot has not been shown in its position of engagement within the heel-holding member in FIG. 1. Said heel-holding member can in any case be replaced by a toe abutment to which the device contemplated by the invention is also applicable.

The heel-holding member 1 is capable of longitudinal displacement on a guide 2 supporting a fixed series of retaining members constituted by a straight rack 3 which is rigidly fixed to the ski. The device further comprises means for adjusting the position of the heel-holding member 1 on the rack 3. In the embodiment illustrated, the means aforesaid comprise an adjustment member 4 carried by a lever 6 which can be displaced within an enclosed space or housing 5 formed within the heel-holding member 1 between a first position (shown in FIG. 1) in which the member 4 (designated hereinafter as the "adjustment member") is in meshing engagement with the rack 3 and a second position (shown in FIG. 2) in which said member 4 is disengaged with respect to the rack 3.

In accordance with the invention, the ski binding device comprises means for ensuring self-locking of the adjustment member 4 in its engaged position on the fixed section member constituted by the rack 3. As a complementary feature of the invention, it is intended to associate the self-locking means aforesaid with means for automatic engagement of the adjustment member 4, starting from its disengaged position with respect to the fixed section member 3.

Figure 3:
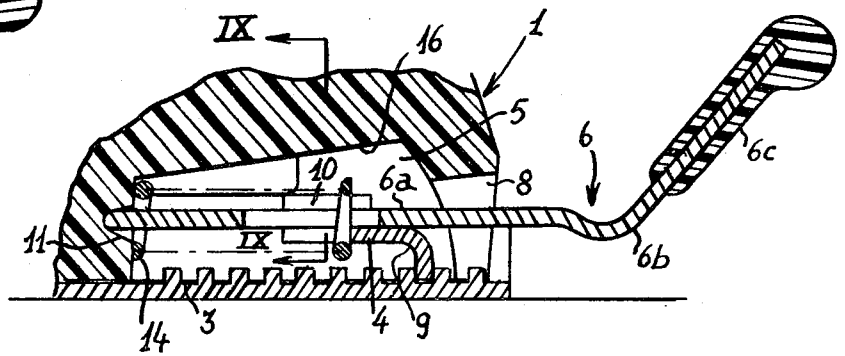
FIG. 3 is a fragmentary part-sectional view which is similar to FIG. 2 and shows the disengaged binding device in which the ski boot is engaged in the heel-holding member.
Figure 2:
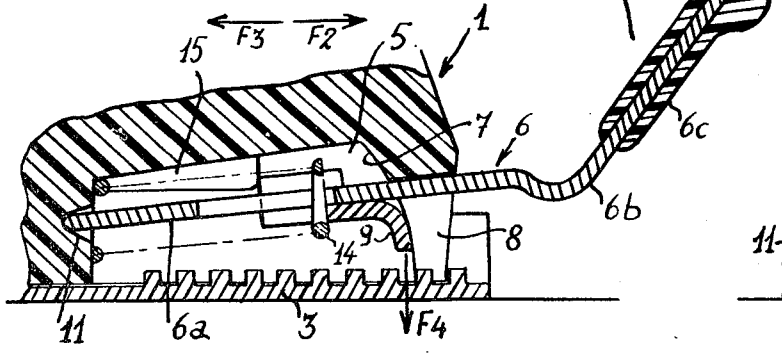
FIG. 2 is a fragmentary part-sectional view showing the binding device of FIG. 1 in its disengaged position.
Figure 4:
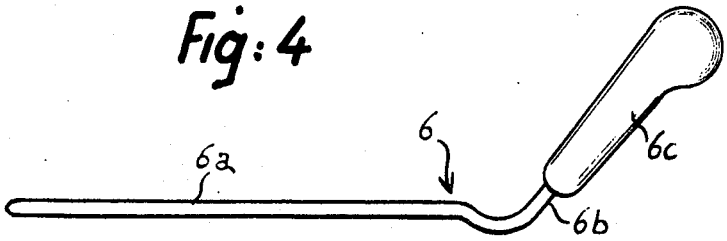
FIGS. 4 and 5 are views respectively in elevation and in plan which illustrate the operating lever of the device shown in FIGS. 1 to 3.

In the embodiment herein described, this combination of means is constituted as follows: the automatic engagement means comprises a slider forming the above-mentioned adjustment member 4 slidably mounted on an operating lever 6 which constitutes the movable element aforesaid. The adjustment member 4 (shown separately in FIGS. 6 to 8) is urged resiliently against a curved wall 7 of the housing 5 when disengaged with respect to the rack 3. As shown in FIGS. 1 to 3, the curved wall 7 has a concave surface directed towards the interior of the housing 5 on each side of a central entrance opening 8 formed in the rear wall of the heel-holding member 1. The adjustment member 4 is provided with a curved tooth or hook 9 disposed transversely to the set of teeth of the rack 3 in order to permit engagement with the latter. Said adjustment member 4 is also slidably mounted on the lever 6 so as to ensure that the tooth 9 is capable of coming into contact with the curved wall 7, especially when the adjustment member 4 is disengaged with respect to the rack 3 (as shown in FIG. 2).

The lever 6 passes through the central opening 8 of the heel-holding member 1 and has a portion 6*a* which is placed within the housing 5 and the end of which engages a notch 11 formed in the end-wall of said housing 5 substantially at the mid-height of said end-wall. The recess or notch 11 has a substantially conical profile with a rounded point so as to permit a predetermined angular displacement of the lever 6 within the opening 8.

The lever 6 has an end portion 6*b* which forms an elbowed projection outside the housing 5 with respect to said straight portion 6*a*. The end portion 6*b* is fitted with a handle 6*c* for gripping the operating lever 6, the handle 6*c* being preferably made of plastic material as in the case of the heel-holding member 1.

Figure 6:
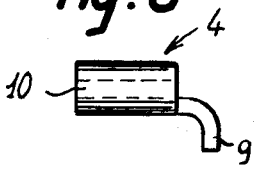
FIG. 6 is a view in elevation showing the slider which forms part of the embodiment shown in FIGS. 1 to 5.
Figure 7:
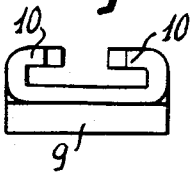
FIG. 7 is a view in elevation showing the slider of FIG. 6 as observed in a direction at right angles to the view of FIG. 6.
Figure 8:
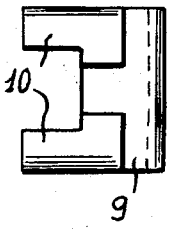
FIG. 8 is a plan view of the slider shown in FIGS. 6 and 7.

As shown in FIGS. 6 to 8, the adjustment member 4 has two arms 10 bent-back at right angles so as to form a slider around the flat portion 6*a* of the lever 6. The curved tooth 9 is fixed transversely to said arms 10 which enable the adjustment member 4 to slide along the operating lever 6. The portion 6*a* of said lever has an elongated slot 12 which is formed longitudinally in that half which is nearest the notch 11 and has a rectangular contour in the example herein described.

Figure 5:
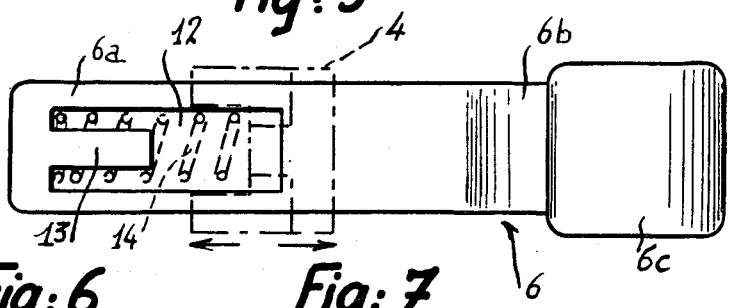

A lug 13 projects within said elongated slot 12 in the plane of the flattened portion 6*a* of the lever 6, starting from that end of said lever which is engaged in the notch 11 as shown in FIG. 5. A resilient member constituted by a helical spring 14 in the example shown in the drawings is mounted at one end partly around the lug 13 within the rectangular slot 12 and applied against the end-wall of the housing 5 around the notch 11.

The spring 14 thus applies a resilient force on the adjustment member 4, accordingly tending to thrust said member towards the concave portion 7 formed within the housing 5 on each side of its entrance opening 8.

In the embodiment which is illustrated, the self-locking means provided by the invention comprise two bosses 15 attached beneath the ceiling or top wall 16 of the housing 5 above the lever 6 and preferably formed in one piece with the heel-holding member 1. Since said heel-holding member is made of plastic material, the bosses 15 can be formed by molding at the time of manufacture of said member.

Figure 9:
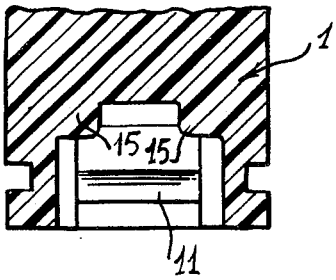
FIG. 9 is a fragmentary part-sectional view of the heel-holding member taken along line IX—IX of FIG. 3 and assuming that the operating lever and its slider have been removed.

The aforementioned bosses 15 are disposed on each side of the longitudinal axis of the operating lever 6 and of the housing 5 as shown in FIG. 9 and have a substantially right-angled cross-section, the bottom face of which is parallel to the surface of the portion 6*a* of the lever 6.

Consideration will now be given to the operation and technical advantages of the ski binding device described in the foregoing.

When the adjustment member 4 has been fitted over the lever 6 and the restoring spring 14 has been mounted within the elongated slot 12, said spring thrusts the member 4 towards the elbowed end portion 6*b* of the handle of the lever 6. If the member 4 is pushed towards that end portion of the lever 6 which is remote from its operating handle 6*c*, the helical spring 14 is compressed, with the result that the entire assembly can be introduced into the housing 5 of the heel-holding member 1. That end portion of the lever 6 which is remote from its operating handle 6*c* then enters the notch 11; the spring 14 is applied against the end wall of the housing 5 around its retaining and guiding lug 13 and thrusts the adjustment member 4 against the two concave surfaces which are located on each side of the entrance opening 8 and constitute the curved portion 7 of the housing 5.

By virtue of the fact that the point of articulation of the lever 6 is located within the notch 11, the adjustment member 4 is applied against the rack 3 and engaged with this latter in the position shown in FIG. 1. The tooth 9 is then in mesh with the rack 3 and the heel-holding member 1 is locked in position on the ski and secured against longitudinal translational motion.

In order to displace the heel-holding member 1 along the guide 2, the handle 6c is gripped and the lever 6 is pulled upwards in the direction of the arrow F1 while causing the end portion of this latter to pivot within the retaining notch 11. The tooth 9 is disengaged from the rack 3 and the heel-holding member 1 can then be displaced longitudinally in either of the two opposite directions indicated by the arrows F2 and F3 in FIG. 2.

When the lever 6 is no longer pulled upwards, the adjustment member 4 is pushed downwards in the direction indicated by the arrow F4 (FIG. 2) and the tooth 9 thus automatically engages with the rack 3. The downward displacement of the adjustment member 4 results from the fact that this latter is thrust resiliently by the spring 14 against the internal concave surface 7 of the housing 5. This surface in fact constitutes a ramp forming a cam which has a profile such that this latter produces action on the tooth 9 of the member 4 in order to return said member in the downward direction.

In consequence, a system for the automatic engagement of the device for length adjustment of the heel-holding member 1 with the fixed section member 3 is provided as a result of the combination of the adjustment member 4, its resilient restoring member 14 and the concave portion 7 along which the tooth 9 of the adjustment member 4 is capable of sliding.

When the boot is mounted in the ski binding as shown in FIG. 3, the normal tension which exists in order to maintain said boot between the toe abutment and the heel-holding member 1 has the effect of exerting a rearward thrust on the boot in the direction of the arrow F2. The heel-holding member 1 consequently moves longitudinally with respect to the fixed section member 3, with the result that the curved portion 7 moves away from the tooth 9 and that the bosses 15 reach a position above the flat portion of the hooking arms 10 which serve to support the adjustment member 4 on the lever 6 (as shown in FIG. 3). Since the member 4 is thus engaged beneath the bosses 15, the lever 6 is secured against vertical motion and any pulling action produced on its handle 6c in the direction of the arrow F1 remains ineffective.

In conjunction with the adjustment member 4, the bosses 15 therefore ensure highly advantageous self-locking of the ski binding device in accordance with the invention, thus practically removing any potential danger of untimely disengagement after a series of violent impacts or jerks.

Automatic engagement carried out in the manner described in the foregoing also represents an appreciable advantage of the device provided by the invention since it is only necessary to release the operating lever 6 in order to carry out engagement followed by locking of the device in the position chosen for the heel-holding member on the rack 3. The device for length-adjustment of the heel-holding member is therefore particularly easy to use.

The fact that the device in accordance with the invention can be disengaged by hand by means of the elbowed portion and the handle 6c of the lever 6 advantageously dispenses with the need for any tool such as a screwdriver or spanner for carrying out the adjustment. Finally, the device contemplated by the invention is of small overall size compared with known forms of construction.

Referring to FIGS. 10 to 13, there will now be described a second embodiment of the ski binding device in accordance with the invention.

In this embodiment, the hand-lever 17 has a general structure which is comparable with that of the lever of the previous form of construction but is slidably mounted through an opening 18 formed in the wall of the heel-holding member 1 which forms the end-wall of the housing 5.

The opening or slotted portion 18 is flared-out towards the interior of the housing 5 and has a substantially frusto-conical configuration in this example in order to permit angular displacement of the operating lever 17 in a plane substantially perpendicular to the plane of the fixed section member constituted by the rack 3 which is rigidly fixed to the ski.

In accordance with an important feature of this form of construction, the adjustment member of the ski binding device is constituted essentially by a curved tooth 19 which is rigidly fixed to the lever 17 and which projects transversely with respect to this latter in the direction of the rack 3. A longitudinal slot 40 having a substantially rectangular contour is formed in that portion of the lever 17 which is engaged within the interior of the housing 5. A helical spring 22 is housed within the cut-out portion or slot 40 and maintained within this latter by fitting around two lugs 23, 24, each lug being intended to project from one end of said slot 40.

Figures 10, 11, 12, 13:
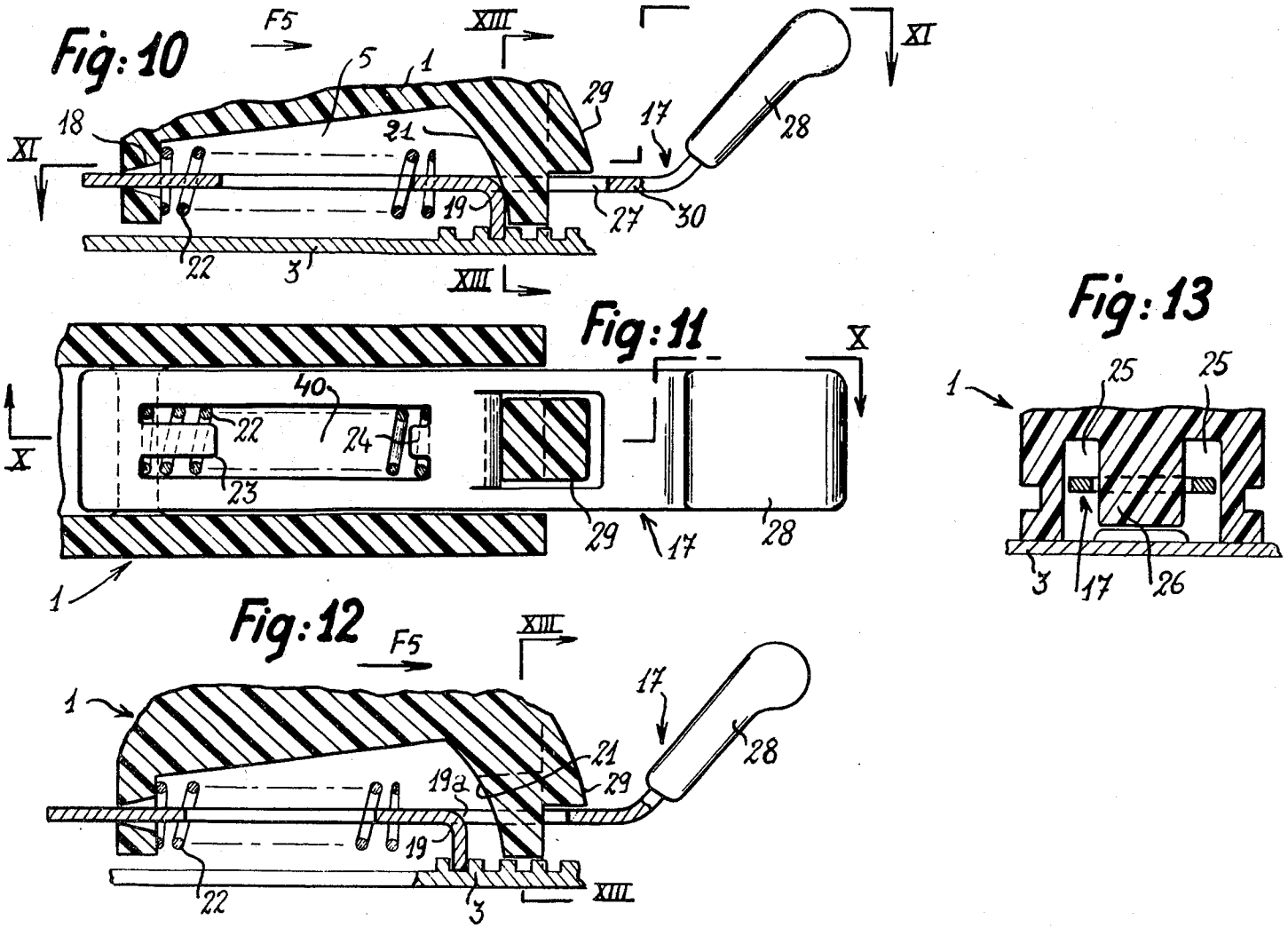
FIG. 10 is a longitudinal fragmentary sectional view taken along line X—X of FIG. 11 and showing a second embodiment of the ski binding device in accordance with the invention, in which the operating lever of said device is in an engaged position.
FIG. 11 is a fragmentary part-sectional plan view taken along line XI—XI of FIG. 10.
FIG. 12 is a sectional view which is similar to FIG. 10, the lever and its adjustment member having moved forward by one notch on the fixed section member which is rigidly fixed to the ski and the lever being locked in position by the heel-holding member.
FIG. 13 is a fragmentary part-sectional view taken along line XIII—XIII of FIG. 12.

In the example herein described, the lug 23 which is located nearest the end opening 18 is distinctly greater in length than the lug 24 located at the opposite end of the slot 40. The lugs 23, 24 aforesaid maintain the resilient member constituted by the spring 22 within the slot 40 and applied against the end-wall of the housing 5 as shown in FIGS. 10 and 12.

At the point of junction with the lever 17, the tooth 19 has a curved surface 19a which is directed towards the entrance of the housing 5 and capable of cooperating by sliding motion with a corresponding curved portion constituted by two concave surfaces 21 formed on that internal wall of the housing 5 which is opposite to the end-wall of this latter. The two surfaces 21 are thus formed on the edges of two similar entrance openings 25 separated by a central tongue 26 (as shown in FIG. 13) which forms part of the casing of the heel-holding member 1 and partially closes-off the entrance of the housing 5.

In accordance with a complementary feature of the invention, the lever 17 is provided with a cut-out portion 27 formed between the adjustment tooth 19 and the operating handle 28, said cut-out portion being traversed by the tongue 26. Since the entrance openings 25 are symmetrical with respect to the longitudinal axis of the rack 3 and are also elongated in the transverse direction with respect to this latter, it is apparent that the operating lever 17 is capable of undergoing a predetermined angular displacement within the openings 25 as a result of pivotal motion of the end portion remote from its operating handle 28 within the frusto-conical opening 18. The tongue 26 accordingly makes it possible to guide the oscillations of the lever 17 in a plane at right angles to the fixed section member 3.

In this form of construction, the self-locking means provided by the invention comprise an excrescence 29 constituted by a nose which is arranged externally with respect to the heel-holding member 1 above the cut-out portion 27 of the lever 17.

The operation of this device takes place as follows:

First of all in order to mount the components of this system, the lever 17 which carries the spring 22 is inserted in the entrance openings 25 and in the end slot 18 of the housing 5. The spring 22 is then compressed whilst the tongue 26 of the heel-holding member passes through the cut-out portion 27 of the lever 17 and the heel-holding member is mounted on the guide. The spring 22 thrusts the lever 17 against the concave surfaces 21 and, as in the previous embodiment, the rounded portion 19*a* of the tooth 19 therefore tends to slide over the contact surfaces 21 and consequently to engage with the teeth of the rack 3. Again in this embodiment, self-engagement of the device in accordance with the invention is therefore achieved.

In order to disengage the device from its engaged position shown in FIG. 10, it is only necessary to draw the lever 17 upwards by means of its operating handle 28. This is possible by virtue of the fact that the nose 29 is positioned within the limits of the cut-out portion 27.

The lever 17 is then pushed through the slot 18 in order to cause the tooth 19 to advance by one or two notches over the rack 3 while compressing the spring 22. When the ski boot is in position within the binding, the normal tension has the effect of applying a rearward thrust on the heel-holding member 1, that is, in the direction represented by the arrow F5.

The solid portion 30 of the lever 17 which is adjacent to the cut-out portion 27 then passes beneath the noses 29 and these latter lock the lever 17 and the tooth 19 which forms a slider in their engaged position as shown in FIG. 12. Any pulling action produced on the lever 17 in the upward direction, that is to say in the direction which tends to move said lever away from the section member 3, remains ineffective by virtue of the fact that the lever 17 and its tooth 19 are locked in their engaged position as shown in FIG. 12.

In this embodiment, the adjustment member constituted by the tooth 19 is therefore rigidly fixed to the operating lever 17 which is capable of longitudinal motion. This arrangement differs from the embodiment shown in FIGS. 1 to 9 in which the operating lever is stationarily fixed in longitudinal translational motion whereas the associated adjustment member constituted by the slider 4 is movable.

The invention is not limited to the two embodiments hereinabove described and accordingly permits many alternative forms of construction. Thus the bosses 15 and the nose 29 which ensure self-locking of the disengagement system can be replaced by any element which performs the same function but has a different arrangement and structure. The same applies to the automatic engagement system constituted by the combination of concave surfaces 7. If necessary, the two bosses 15 could be reduced to only one boss although the technical effect is liable to be less satisfactory than in the form of construction hereinabove described.

In regard to the advantages of the adjustment device designed in accordance with the invention, it would be well to add to those mentioned in the foregoing the fact that said device provides the heel-holding member with a certain degree of elasticity in the longitudinal direction, which is necessary for good operation when the ski is subjected to bending stresses.

I claim:

1. A device for binding a ski boot on a ski, wherein said device comprises a base adapted to be fixed on a ski, a binding member slidably mounted on said base for displacement in the direction of the longitudinal axis of the ski an adapted to grip one end of the ski boot, means for adjusting the position of said binding member on said base, said means comprising a series of retaining members spaced in the longitudinal direction on the base, an adjustment member adapted to engage one of said retaining members, a lever carrying said adjusting member and movably mounted on the boot-binding member for displacement between a first position in which the adjustment member is engaged with one of said retaining members and a second position in which said adjustment member is disengaged from said retaining members, the boot-binding member being capable of displacement in one longitudinal direction with respect to said adjustment member under the action of the pressure exerted by the ski boot when said boot is in position, resilient means urging the binding member in the opposite direction, and locking means carried by said boot-binding member urging said adjustment member into engagement with one of said retaining members when the binding member has been displaced in the said one longitudinal direction under the pressure exerted by the ski boot when said boot is in position.

2. A device for binding a ski boot on a ski according to claim 1, in which said locking means urges said lever in a direction to maintain said adjustment member in engagement with one of said retaining members when the binding member has been displaced in the said one longitudinal direction under pressure exerted by the ski boot when said ski boot is in position.

3. A device for binding a ski boot on a ski according to claim 1, in combination with means slidably mounting said adjustment member on said lever for displacement in the longitudinal direction, and in which said resilient means is interposed between said binding member and said adjustment member.

4. A binding device according to claim 2, in which the adjustment member is rigidly attached to said lever while said boot-binding member is movably mounted for displacement in the longitudinal direction with respect to said lever, and in which the resilient means acting upon said binding member is interposed between said binding member on the one hand and said lever on the other hand.

5. A binding device according to claim 1, in which said adjustment member is supported on said lever in an enclosed space provided within the binding member and in which said locking means is also positioned within said enclosed space.

6. A binding device according to claim 2, in which said locking means comprises an extension of said binding member so positioned as to project in the direction towards which the binding member is thrust under the action of the pressure exerted by the ski boot when said ski boot is in position.

7. A binding device according to claim 1, in combination with means acting upon said adjustment member to bring said member together with its carrying lever into a position of engagement with one of said retaining members as soon as said lever is moved to its second position.

8. A binding device according to claim 2, in combination with means acting upon said adjustment member to bring said member together with its carrying lever into a position of engagement with one of said retaining members as soon as said lever is moved to its second position.

9. A binding device according to claim 3, in which the adjustment member slidably mounted on said lever is positioned within an enclosed space formed within the binding member, and in which said enclosed space is formed with a ramp tending to thrust back said adjustment member and lever into a position in which said adjustment member engages one of said retaining members.

10. A binding device according to claim 4, in which said adjustment member is positioned within an enclosed space within the binding member and in which said enclosed space is formed with a ramp adapted to thrust back said lever into a position in which said adjustment member is engaged with one of said retaining members.

* * * * *